US005650791A

United States Patent [19]

Talty

[11] Patent Number: 5,650,791

[45] Date of Patent: Jul. 22, 1997

[54] MULTIBAND ANTENNA FOR AUTOMOTIVE VEHICLE

[75] Inventor: Timothy Joseph Talty, Trenton, Mich.

[73] Assignee: Ford Motor Company, Dearborn, Mich.

[21] Appl. No.: 523,317

[22] Filed: Sep. 5, 1995

[51] Int. Cl.[6] ..... H01Q 1/32

[52] U.S. Cl. ..... 343/713; 343/744

[58] Field of Search ..... 343/713, 742, 343/744, 745, 868, 741; H01Q 1/32

[56] References Cited

U.S. PATENT DOCUMENTS

| | | | |
|---|---|---|---|
| 3,599,214 | 8/1971 | Altmayer | 343/713 |
| 3,771,159 | 11/1973 | Kawaguchi et al. | 343/713 |
| 3,972,048 | 7/1976 | Davis | 343/742 X |
| 4,003,056 | 1/1977 | Davis | 343/704 |
| 4,145,693 | 3/1979 | Fenwick | 343/722 |
| 4,184,164 | 1/1980 | Rod | 343/744 |
| 4,331,961 | 5/1982 | Davis | 343/713 X |
| 4,381,566 | 4/1983 | Kane | 343/747 |
| 4,527,164 | 7/1985 | Cestaro et al. | 343/713 |
| 4,791,426 | 12/1988 | Lindenmeier et al. | 343/713 |
| 5,442,368 | 8/1995 | Harada et al. | 343/713 |

FOREIGN PATENT DOCUMENTS

| | | | |
|---|---|---|---|
| 960759 | 1/1975 | Canada | 343/713 |

*Primary Examiner*—Donald T. Hajec
*Assistant Examiner*—Tho Phan
*Attorney, Agent, or Firm*—Mark Mollon

[57] ABSTRACT

A multiband antenna for mounting on glass for an automotive vehicle window is disposed around the periphery of the window to provide a long length for the AM antenna. A series capacitor decouples one end of the AM monopole antenna from ground. The capacitive element acts as a short circuit at FM frequencies to facilitate operation of the antenna as a dipole for FM signals. A pair of inductive elements is connected in series with the antenna radiating element to effectively trim the length of the antenna to a resonant length for FM frequencies.

14 Claims, 2 Drawing Sheets

MULTIBAND ANTENNA FOR AUTOMOTIVE VEHICLE

BACKGROUND OF THE INVENTION

The present invention relates in general to an AM/FM broadcast reception antenna for a vehicle, and more specifically to a multiband antenna that may be located around the perimeter of a panel of window glass.

As an alternative to standard whip antennas, surface conformal antennas are often used on automobiles to obtain advantages of better resistance to damage, elimination of wind noise, and less negative impact on styling. An on-glass antenna is one type of conformal antenna. It is formed using known techniques such as silk-screen printing operations for depositing a silver ceramic paste to form antenna conductors, antenna feedlines, and antenna terminals. After depositing the silver ceramic paste, the glass sheet is placed on a fixture and heated in an oven to a temperature adequate to bond the silver ceramic paste to the glass sheet. Details on forming conductive segments and terminals on a glass sheet are provided in commonly assigned U.S. Pat. Nos. 4,246,467 and 4,388,522, incorporated herein by reference.

Despite the potential advantages of on-glass antennas, their acceptance has been slow due to the difficulty of meeting adequate performance standards with on-glass antennas. Many different on-glass antenna patterns have been tried in an effort to improve antenna performance. Many patterns intrude upon the visible area of a window which has an undesirable effect on styling appearance.

In the case of multiband antennas intended to receive both AM and FM signals via a single antenna feed line, incompatible antenna requirements have compromised the effectiveness of on-glass antennas. For example, an AM antenna needs to be as long as possible in order to maximize signal reception (because the length of an AM antenna is much shorter than the AM wavelength). In contrast, the length of an FM antenna is comparable to an FM wavelength and, therefore, the antenna length must be selected to be resonant at the FM frequencies of interest (e.g., quarter-wave, half-wave, or full-wave). Thus, as antenna length is increased in an effort to improve AM reception, FM reception suffers if the antenna length is increased beyond a resonant length for the FM frequencies.

In order to provide acceptable performance, an on-glass antenna must also provide sufficient bandwidth (i.e., gain across the frequency band of interest). Co-pending application Ser. No. 08/379,409, filed Jan. 27, 1995, entitled "VEHICLE WINDOW GLASS ANTENNA ARRANGEMENT", hereby incorporated by reference, discloses that the diameter of an antenna conductor can be increased in order to increase bandwidth. Thus, the width of the antenna conductor traces on the glass can be widened to increase bandwidth; however, visibility through the window is decreased.

The competing requirements of different bands can be addressed by adopting separate antennas or antenna feeds. Multiple coaxial transmission lines running from the antenna to the receiver can be avoided by combining the separate antenna signals using an electrical network. Such a network, however, involves the added complexity and expense of a separate module. In order to limit the complexity and expense of an on-glass antenna system, the number of antenna feeds needs to be kept to a minimum.

SUMMARY OF THE INVENTION

The present invention overcomes the above-mentioned disadvantages by providing a multiband antenna for which AM and FM reception can be optimized while avoiding obscuration of visible areas of a window and minimizing a number of antenna feeds. In particular, an AM/FM antenna may use only a single antenna feed. A single radiating element is segmented using lumped capacitive and inductive elements to provide simultaneous operation in both monopole and dipole modes in a plurality of frequency bands.

In particular, the invention provides a multiband AM/FM antenna and receiver system for a mobile vehicle. A vehicle panel provides a surface area over any chosen portion of the panel. A radiating antenna element is disposed at the perimeter of the surface area. A coaxial transmission line with first and second ends and having a main conductor and a shield conductor is coupled at the first end of the transmission line to respective ends of the radiating antenna element. A radio receiver has an antenna input coupled to the second end of the transmission line. A capacitive element is connected in series with the radiating antenna element and the shield conductor so that the antenna system is a monopole antenna for AM frequencies and is a dipole antenna for FM frequencies. A pair of inductive elements may be connected in series with the radiating antenna element at selected points along the perimeter to provide a selected resonant length for the FM dipole antenna.

DETAILED DESCRIPTION OF PREFERRED EMBODIMENTS

Figure 1:
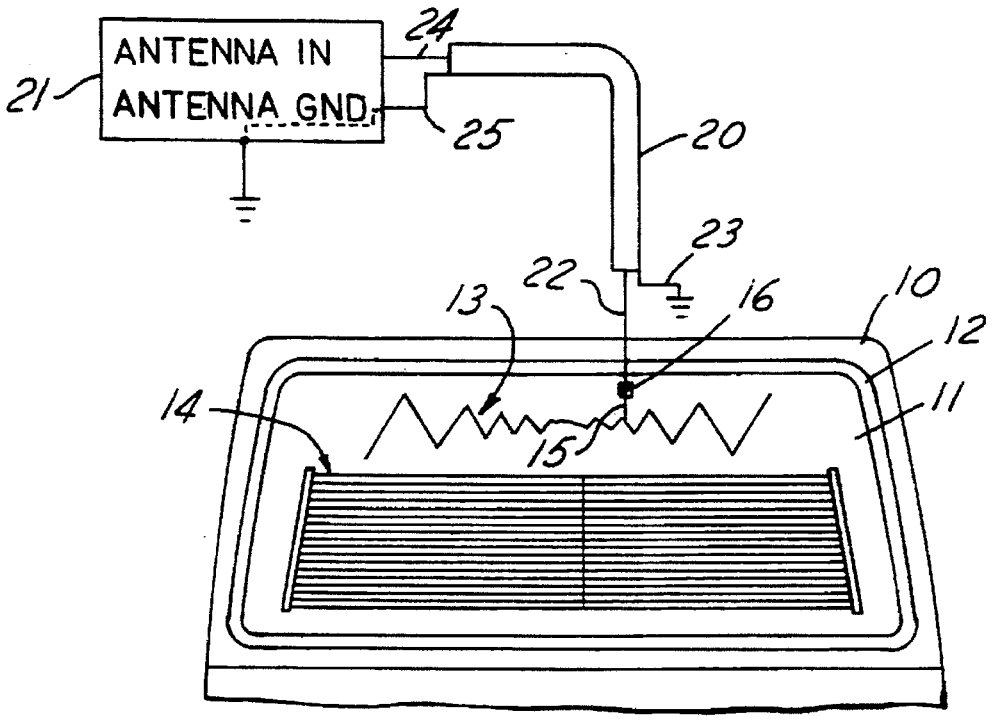
(PRIOR ART) FIG. 1
FIG. 1 is a front plan view showing a rear automobile window having a printed on-glass antenna and heater grid, and a coaxial transmission line connected to a radio receiver.

Referring to FIG. 1, a vehicle body surface 10 (such as a roof and support structure) includes an opening for receiving a window 11. The area where window 11 is joined to body surface 10 is covered by a trim piece 12. Contained on or within glass 11 are an antenna 13 and a heater grid 14. Antenna 13 and heater grid 14 are preferably formed on glass 11 using the same process and materials, such as printing of a silver ceramic paste. A feedline 15 connects antenna 13 to an antenna terminal 16 also mounted on glass 11. Antenna 13 may be intended for both AM and FM operation or for FM reception only. A separate AM antenna can be implemented using heater grid 14 as a radiator.

Antenna 13 has a hybrid monopole/log-periodic shape as described in co-pending application Ser. No. 07/945,037, filed Sep. 15, 1992, entitled "HYBRID MONOPOLE/LOG-PERIODIC ANTENNA" which is incorporated herein by reference.

A coaxial cable or transmission line 20 connects antenna 13 with a broadcast receiver 21. Coaxial transmission line 20 includes a main conductor at its axial center and a shield conductor cylindrically disposed around the main conductor. The main conductor has a first end 22 connected to antenna terminal 16. The shield conductor has a first end 23 connected to ground at the vehicle body in the vicinity of window 11. The main conductor has a second end 24 connected to an antenna input on receiver 21. The shield conductor has a second end 25 connected to an antenna ground input of receiver 21 and is connected via the receiver's internal circuitry to chassis ground.

Figure 2:
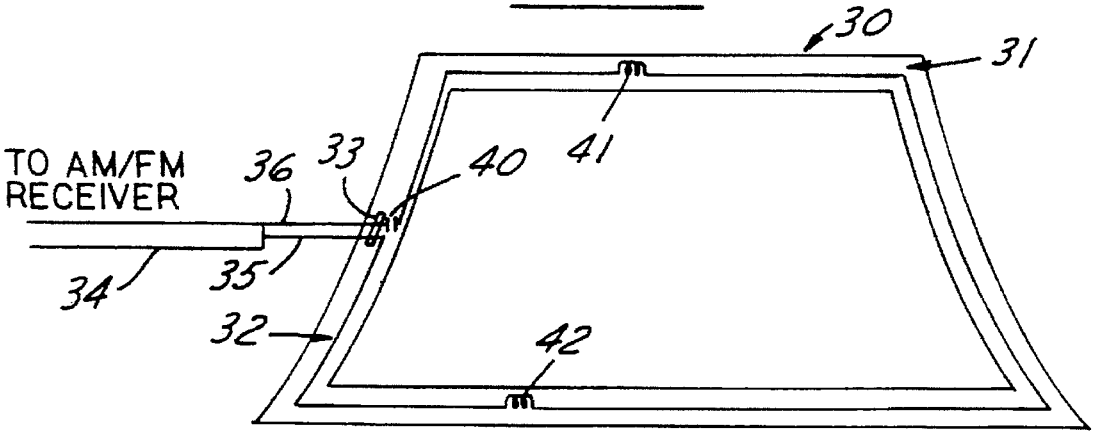
FIG. 2 is a front plan view showing the on-glass antenna of the present invention.

An AM/FM antenna according to the present invention is shown in FIG. 2. A glass panel 30 for forming a window includes a body mounting area 31 around its edges. Mounting area 31 is adapted to be connected to the vehicle body by an adhesive and can be partly or entirely covered by a trim piece after installation. Mounting area 31 is further typically painted with black paint to assist the trim piece in obscuring adhesives applied along the edge of the glass panel. A rubber seal (not shown) is typically also applied around the glass edge to seal against moisture penetration.

The present invention provides a very long AM antenna structure by providing a radiating antenna element disposed around the full perimeter of the surface area of glass panel 30. Radiating antenna element 32 has first and second ends connected to an antenna terminal 33. A coaxial transmission line 34 has a main conductor 35 coupled to the first end of radiating element 32 through antenna terminal 33 and a shield conductor 36 coupled to the second end of radiating antenna element 32 via antenna terminal 33.

If radiating antenna element 32 were merely a continuous loop, all AM signals would be lost to ground via the chassis ground connection at the receiver since the wavelength for AM signals is large compared to the combined antenna and transmission line lengths. In order to avoid loss of AM signals, a capacitive element 40 is connected in series with radiating antenna element 33 and shield conductor 36. Capacitive element 40 has a capacitance selected to provide a high impedance to AM frequencies, e.g., about 100 picoFarads. This capacitance effectively isolates radiating antenna element 32 from shield conductor 36 by behaving as an open circuit at AM frequencies, thereby preventing loss of AM signal to ground. Thus, the antenna behaves as a monopole antenna having a total length equal to the perimeter of glass panel 30 at AM frequencies. Shield conductor 36 is nevertheless grounded at the receiver and, therefore, continues to provide a shielding effect. The vehicle body continues to act as a ground plane for the monopole antenna via the chassis ground.

Capacitive element 40 has a capacitance which has a very low impedance at FM frequencies. Thus, the antenna operates as a dipole for FM frequencies. However, the perimeter of a typical front or rear window in an automotive vehicle is longer than an appropriate length for an FM antenna since the length would not correspond to a resonant length. In order to adjust the length of the FM dipole antenna, a pair of inductive elements 41 and 42 are inserted in series with the radiating antenna element at selected points along the perimeter, thereby creating a pair of dipole antenna arms. Inductive elements 41 and 42 have an inductance which provides a high impedance at FM frequencies but a low impedance at AM frequencies. Thus, inductive elements 41 and 42 act as open circuits for FM signals thereby trimming the lengths of the two arms of the FM dipole antenna to the appropriate resonant lengths (a length of about0.75 meters for each arm and a total length of 1.5 meters, for example) and act as short circuits for AM signals. An inductance for inductive elements 41 and 42 of about 1.0 microHenrys provides the appropriate impedance characteristic.

Radiating antenna element 32 is formed of a conductive trace deposited on glass panel 30 as described above. Capacitive 40 and inductive elements 41 and 42 are preferably comprised of surface mount devices (SMD). Thus, a gap is left in the trace for radiating antenna element 32 at the points where an SMD capacitor or inductor may be attached by soldering.

Figure 3:
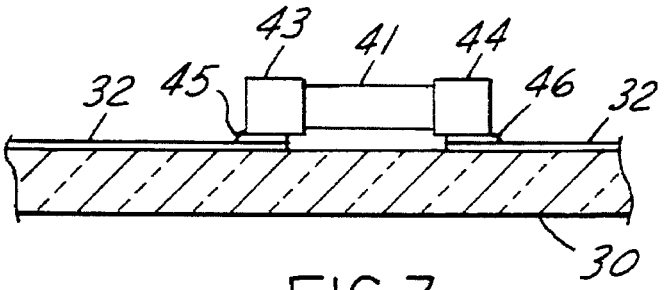
FIG. 3 is a side view showing a surface mount circuit element mounted to a glass sheet as used in the present invention.

For example, FIG. 3 shows a side view of the mounting of inductive element 41. Glass panel 30 supports trace 32 with a gap in trace 32 bridged by surface mount inductor 41. Surface mount inductor 41 has a pair of terminals 43 and 44 at opposite ends. Terminal 43 is soldered to trace 32 using solder bead 45 while terminal 44 is soldered to trace 32 using solder bead 46. Solder may be applied to the SMD in the form of a paste for subsequent reflow soldering to trace 32 by heating.

Figure 4:
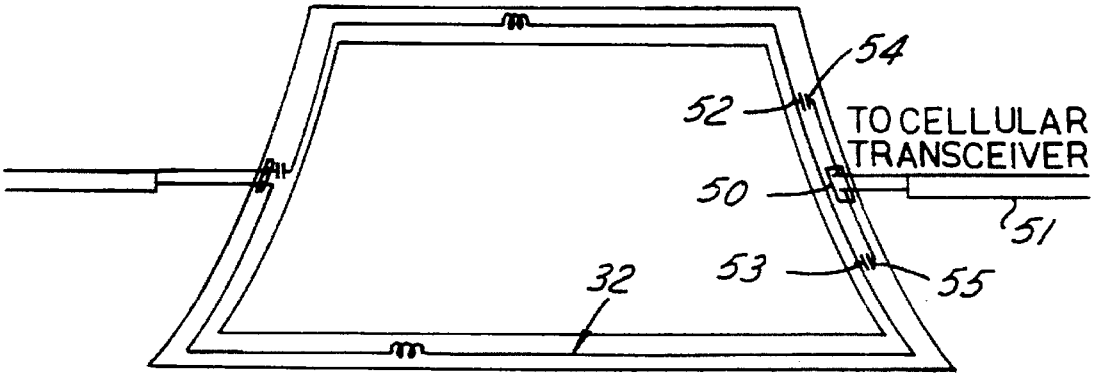
FIG. 4 is a plan view showing an alternative embodiment of the present invention.

Reception of a supplemental (i.e., third) frequency band can be obtained using the antenna of the invention as shown in FIG. 4. A portion of radiating antenna element 32 along the perimeter can be adapted to form an antenna for another frequency band of interest by selecting an appropriate length and using appropriate coupling to the portion by separate elements. Thus, an antenna adapted to provide reception and transmission for a cellular transceiver is shown including a separate antenna feed including an antenna terminal 50. The cellular transceiver (not shown) is connected to antenna terminal 50 via a separate coaxial transmission line 51 in a manner similar to that described above. A dipole antenna is formed by connecting the antenna feed to spaced points 52 and 53 along the perimeter of radiating antenna element 32. Thus, a loop dipole antenna is formed including the portion of radiating antenna element 32 between points 52 and 53. A pair of coupling capacitors 54 and 55 provide a high impedance at AM frequencies to isolate AM signals from the cellular transceiver and to ensure that AM performance of the antenna is not affected. Capacitors 54 and 55 may preferably be comprised of surface mount devices attached to traces on glass sheet 30 by reflow soldering. Capacitors 54, 55 and 40 could alternatively be formed integral with antenna terminals 50 and 33 using well-known techniques such as a bolt structure. It is also possible to relocate the decoupling capacitors to the opposite end of the coaxial transmission line or even in the receiver or transceiver themselves where the cost of a capacitor may be lower.

Figure 5:
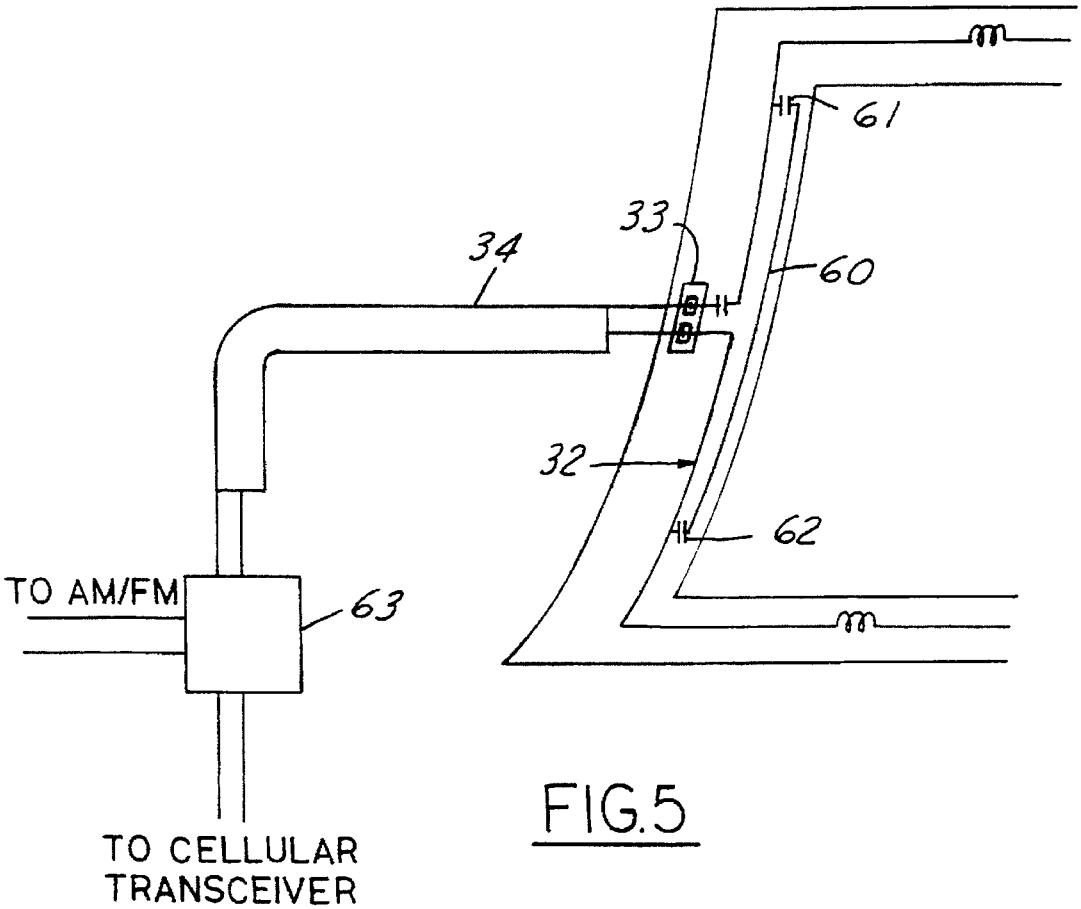
FIG. 5 is a front plan view showing a modification to the antenna of the present invention connected to an AM/FM receiver and a cellular transceiver.

FIG. 5 shows a further embodiment wherein a cellular antenna is integrated with a single antenna terminal/feed for the cellular antenna and the AM/FM antennas. A separate antenna loop is formed by portions of radiating element 32 and a loop segment 60. A pair of capacitive elements 61 and 62 connect loop segment 60 to radiating element 32 such that the length of the loop provides resonance at cellular frequencies (824 to 896 MHz). Capacitive elements 61 and 62 provide a high impedance to AM and FM frequencies but a low impedance to cellular frequencies (e.g., a capacitance of about 10 picoFarads). Alternatively, a single capacitor could be used to break this supplemental antenna loop at AM and FM frequencies. Depending upon where the single capacitor is located, some additional conductor would be added to the AM and/or FM radiators, which might need to be accounted for in the system design.

Since a cellular transceiver both transmits and receives, its transmission signals must be isolated from the AM/FM inputs of the AM/FM receiver. Therefore, a circulator 63 is connected to coaxial transmission line 34 to separate such signals. Circulator 63 may further include filter networks to separate (i.e., crossover) signals into appropriate bands for connection to the respective receiver or transceiver.

Although the present invention has been disclosed with reference to a window glass panel, it will be apparent to those skilled in the art that the invention is useful for other vehicle panels such as body panels, roof panels, deck lids, or interior panels of a vehicle provided such panel is not shielded from RF signals by intervening metal structure. When applied to another panel, wherein the surface area may be any portion or subportion of the panel, the radiating antenna element disposed around the perimeter of the surface area may be required to be insulated if the vehicle panel is metallic. In such other embodiments, discrete devices may be used for the capacitive and inductive elements.

We claim:

1. A multiband AM/FM antenna and receiver system for a mobile vehicle comprising:

a vehicle panel providing a surface area;

a radiating antenna element disposed at the perimeter of said surface area;

a coaxial transmission line with first and second ends and having a main conductor and a shield conductor, said main conductor and said shield conductor being coupled at said first end of said transmission line to respective ends of said radiating antenna element;

a radio receiver having an antenna input coupled to said second end of said transmission line;

a capacitive element connected in series with said radiating antenna element and said shield conductor so that said antenna system is a monopole antenna for AM frequencies and is a dipole antenna for FM frequencies; and a pair of inductive elements connected in series with said radiating antenna element at selected points along said perimeter providing a selected resonant length for said FM dipole antenna.

2. The system of claim 1 wherein said capacitive element is connected between said radiating antenna element and said shield conductor.

3. The system of claim 2 wherein said capacitive element is comprised of a surface mount capacitor mounted to said vehicle panel.

4. The system of claim 1 wherein said inductive elements are comprised of surface mount inductors mounted to said vehicle panel.

5. The system of claim 1 wherein said vehicle panel is comprised of a sheet of glass.

6. The system of claim 5 wherein said radiating antenna element is comprised of a conductive trace mounted on said sheet of glass.

7. The system of claim 5 wherein said sheet of glass is shaped to provide a window of said mobile vehicle.

8. A multiband antenna system comprising:

a panel providing a surface area;

a radiating loop disposed at the perimeter of said surface area, said radiating loop having a first loop end and a second loop end;

a capacitive element coupled in series with said second loop end to provide an AM antenna signal between said first loop end and said capacitive element, the full length of said radiating loop operating as an AM antenna; and a pair of inductive elements connected in series with said radiating loop at selected points along said perimeter to provide an FM antenna signal between said first and second loop ends with a portion of said radiating loop between said inductive elements not receiving said FM antenna signal.

9. The antenna system of claim 8 further comprising:

a supplemental antenna feed including a pair of capacitive feed elements connected to respective locations along said perimeter to provide a supplemental antenna signal for a supplemental frequency band.

10. The antenna system of claim 9 wherein said capacitive feed elements are connected between their respective locations and a respective first or second loop end.

11. The antenna system of claim 10 further comprising a filter coupled to said first and second loop ends for separating AM signals, FM signals, and supplemental frequency band signals from one another.

12. The antenna system of claim 11 wherein said antenna system provides a transmit and receive antenna at said supplemental frequency band, and wherein said antenna system further comprises a circulator coupled to said first and second loop ends.

13. The antenna system of claim 9 wherein said supplemental antenna signal is isolated from said first and second loop ends.

14. The antenna system of claim 9 wherein said supplemental frequency band is a cellular telephone band.

* * * * *